US009651882B2

(12) United States Patent
Chiba et al.

(10) Patent No.: US 9,651,882 B2
(45) Date of Patent: May 16, 2017

(54) ELECTROSTATIC IMAGE DEVELOPER

(71) Applicant: ZEON CORPORATION, Tokyo (JP)

(72) Inventors: Takeru Chiba, Tokyo (JP); Hiroshi Nakatani, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 14/770,243

(22) PCT Filed: Feb. 21, 2014

(86) PCT No.: PCT/JP2014/054224
§ 371 (c)(1),
(2) Date: Aug. 25, 2015

(87) PCT Pub. No.: WO2014/132900
PCT Pub. Date: Sep. 4, 2014

(65) Prior Publication Data

US 2016/0004177 A1 Jan. 7, 2016

(30) Foreign Application Priority Data

Feb. 27, 2013 (JP) ..... 2013-037345

(51) Int. Cl.
*G03G 9/08* (2006.01)
*G03G 9/097* (2006.01)

(52) U.S. Cl.
CPC ..... *G03G 9/0827* (2013.01); *G03G 9/0819* (2013.01); *G03G 9/09708* (2013.01); *G03G 9/09791* (2013.01)

(58) Field of Classification Search
CPC ..... G03G 9/0827; G03G 9/0819; G03G 9/09708; G03G 9/09791
(Continued)

(56) References Cited

U.S. PATENT DOCUMENTS 5,437,954 A * 8/1995 Saito ..... G03G 9/09716 430/108.6
2014/0050925 A1 2/2014 Sueda et al.

FOREIGN PATENT DOCUMENTS

JP 1-273056 A 10/1989
JP 4-124678 A 4/1992
(Continued)

OTHER PUBLICATIONS

Notification of Transmittal of Translation of the International Preliminary Report on Patentability (Form PCT/IB/338) issued in counterpart International Application No. PCT/JP2014/054224 mailed Sep. 11, 2015 with Forms PCT/IB/373 and PCT/ISA/237 (6 pages).

*Primary Examiner* — Mark A Chapman
(74) *Attorney, Agent, or Firm* — Westerman, Hattori, Daniels & Adrian, LLP

(57) ABSTRACT

Disclosed is an electrostatic image developer containing colored resin particles containing a binder resin and a colorant, and an external additive, wherein, as the external additive, the electrostatic image developer contains plate-shaped zinc oxide fine particles having an average longer length of 50 to 2,000 nm and a value S of 0.0001 to 0.03 $nm^{-1}$, which is a value obtained by dividing an average thickness d of the particles by an average base area A of the particles, and a content of the plate-shaped zinc oxide fine particles is in the range from 0.05 to 1 part by mass, with respect to 100 parts by mass of the colored resin particles.

5 Claims, 1 Drawing Sheet

(58) Field of Classification Search
USPC ..... 430/108.6
See application file for complete search history.

(56) References Cited

FOREIGN PATENT DOCUMENTS

| | | | |
|---|---|---|---|
| JP | 5-119515 | A | 5/1993 |
| JP | 9-325511 | A | 12/1997 |
| JP | 10-48873 | A | 2/1998 |
| JP | 2006-72121 | A | 3/2006 |
| JP | 2007-121481 | A | 5/2007 |
| JP | 2011-203666 | A | 10/2011 |
| JP | 2012-68497 | A | 4/2012 |
| WO | 2012/147886 | A1 | 11/2012 |

* cited by examiner

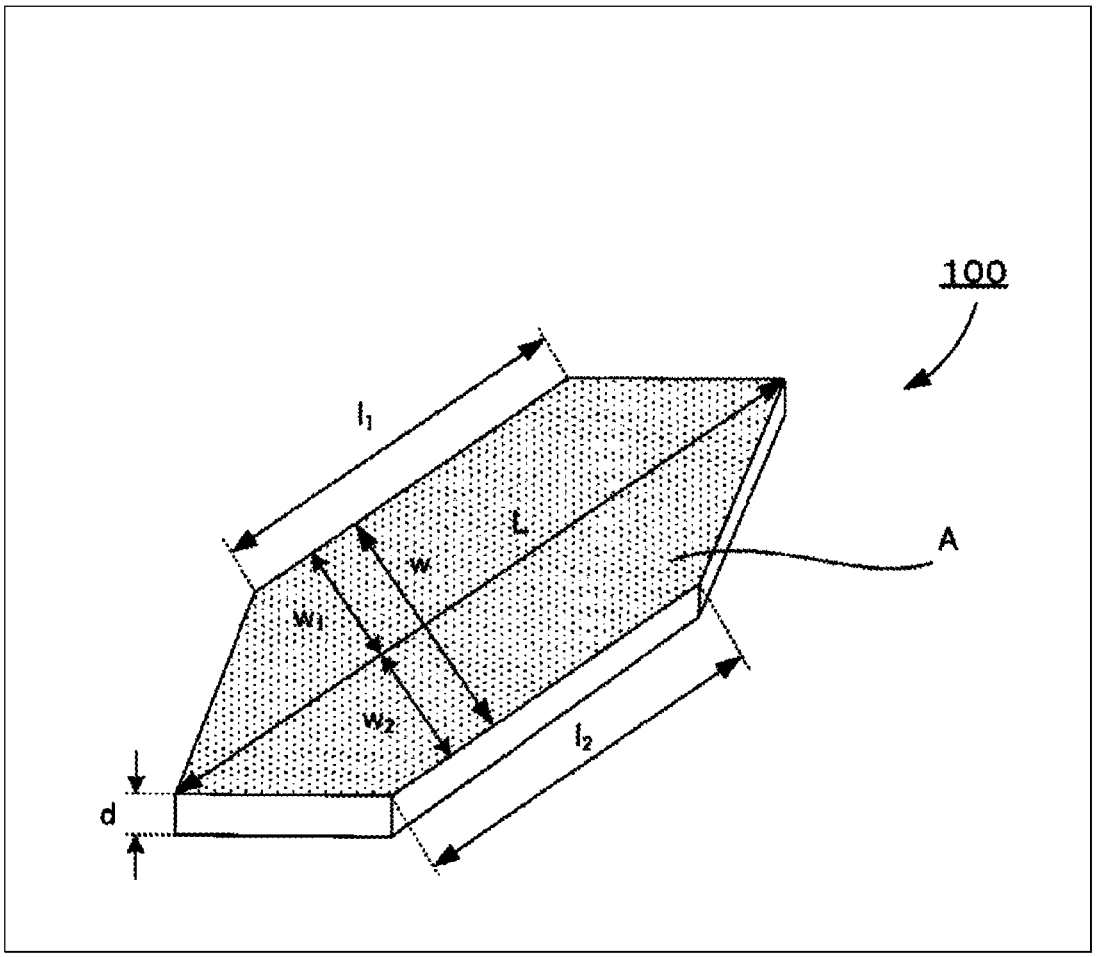
100
$l_1$
L
w
A
$w_1$
$w_2$
$l_2$
d

ELECTROSTATIC IMAGE DEVELOPER

TECHNICAL FIELD

The present invention relates to an electrostatic image developer that can be used for development in image forming devices using electrophotography, such as a copy machine, a facsimile machine and a printer.

BACKGROUND ART

Conventionally, developers generally used in electrophotography can have desired flowability and charging characteristics by attaching external additives on the surfaces of colored resin particles. As external additives, inorganic particles and organic particles are generally used. As such external additives, metal oxide particles, resin particles and these particles subjected to a surface treatment have been widely used. Among them, particularly, particles of metal oxides such as silica, titania, alumina and zinc oxide, particles of fatty acid metal salts, and these particles subjected to a hydrophobicity-imparting treatment are often used. They are also generally used in combination of two or more kinds.

For example, in Patent Literature 1, an electrostatic image developing toner made of toner particles and zinc oxide fine particles is disclosed, wherein the toner particles contain particles essentially made of a thermoplastic resin-based binder and a pigment, and the zinc oxide fine particles are attached on the surface of the toner particles and covered with a modified silicone oil that contains at least one organic group selected from an amino group and an epoxy group. It is also disclosed that the toner gives an image with less fog and is excellent in durability. In Patent Literature 2, a negative charge type toner obtained by covering spherical polyester resin particles containing colorant particles with a plurality of hydrophobized external additives is disclosed, wherein at least negative charge type silica particles, rodlike polyhedral hexagonal zinc oxide particles and positive charge type silica particles are used as the external additives. It is also disclosed that the toner is excellent in charge stability, ensures neither toner leakage nor toner scattering, and gives a printed image free of unevenness.

In Patent Literature 3, a positively chargeable toner is disclosed, which contains toner base particles surface-treated with an external additive that contains zinc oxide fine particles subjected to a positive charging property-imparting treatment and a silicone oil treatment, in which the amount of an agent used in the positive charging property-imparting treatment and the amount of the silicone oil used in the silicone oil treatment are at a specific ratio. It is also disclosed that the positively chargeable toner causes no decrease in charge amount, even in long-term use, and gives an image that hardly causes toner scattering or fog.

However, in different environments, the toners disclosed in these patent literatures are insufficient to inhibit fog, and sometimes they are difficult to maintain a toner conveyance amount that is close to the beginning of printing even during continuous printing, with satisfying a latest demand for high speed printing and maintaining low-temperature fixability.

CITATION LIST

Patent Literature 1: Japanese Patent Application Laid-Open (JP-A) No. H9-325511

Patent Literature 2: JP-A No. 2007-121481

Patent Literature 3: JP-A No. 2012-68497

SUMMARY OF INVENTION

Technical Problem

An object of the present invention is to provide an electrostatic image developer which is able to inhibit fog in both a high temperature and high humidity environment and a low temperature and low humidity environment, and which is able to maintain a toner conveyance amount that is close to the beginning of printing even during continuous printing, with maintaining excellent low-temperature fixability.

Solution to Problem

As a result of diligent research on external additives that constitute a toner for developing electrostatic images along with colored resin particles, the inventors of the present invention have found that the above-mentioned object can be achieved by using plate-shaped zinc oxide fine particles having a specific particle diameter and a value in a specific range, the value being obtained by dividing the thickness of the particles by the base area of the particles.

That is, according to the present invention, an electrostatic image developer is provided, which comprises colored resin particles containing a binder resin and a colorant, and an external additive, wherein, as the external additive, the electrostatic image developer contains plate-shaped zinc oxide fine particles having an average longer length of 50 to 2,000 nm and a value S of 0.0001 to 0.03 $nm^{-1}$, which is a value obtained by dividing an average thickness d of the particles by an average base area A of the particles, and a content of the plate-shaped zinc oxide fine particles is in the range from 0.05 to 1 part by mass, with respect to 100 parts by mass of the colored resin particles.

In the present invention, it is preferable that the electrostatic image developer comprises the colored resin particles containing the binder resin, the colorant and a charge control agent, and the external additive, wherein, as the external additive, the electrostatic image developer contains the plate-shaped zinc oxide fine particles having an average longer length of 50 to 2,000 nm and a value S of 0.0001 to 0.03 $nm^{-1}$, which is the value obtained by dividing the average thickness d of the particles by the average base area A of the particles, and the content of the plate-shaped zinc oxide fine particles is in the range from 0.05 to 1 part by mass, with respect to 100 parts by mass of the colored resin particles.

In the present invention, the base of the plate-shaped zinc oxide fine particles can be hexagonal.

In the present invention, it is preferable that as the external additives, the electrostatic image developer further contains inorganic fine particles A having a number average primary particle diameter of 36 to 200 nm and inorganic fine particles B having a number average primary particle diameter of 7 to 35 nm, and with respect to 100 parts by mass of the colored resin particles, the electrostatic image developer contains the inorganic fine particles A in the range from 0.1 to 3 parts by mass and the inorganic fine particles B in the range from 0.1 to 2 parts by mass.

In the present invention, it is preferable that as the external additive, the electrostatic image developer further contains fatty acid metal salt fine particles having a number average primary particle diameter of 0.05 to 5 μm.

In the present invention, the plate-shaped zinc oxide fine particles preferably have a BET specific surface area of 1 to 50 $m^2/g$.

Advantageous Effects of Invention

According to the above-mentioned electrostatic image developer of the present invention, by containing, as the external additive, a specific amount of plate-shaped zinc oxide fine particles having a specific size, a toner which is able to exhibit excellent low-temperature fixability, which is able to maintain a toner conveyance amount that is almost the same as the beginning of printing even during continuous printing, and which is less likely to cause initial fog in both a high temperature and high humidity (H/H) environment and a low temperature and low humidity (L/L) environment, can be provided.

BRIEF DESCRIPTION OF DRAWING

The FIGURE is a schematic perspective view of hexagonal plate-shaped zinc oxide fine particles that are preferably used in the present invention.

DESCRIPTION OF EMBODIMENTS

The electrostatic image developer of the present invention is an electrostatic image developer containing colored resin particles containing a binder resin and a colorant, and an external additive, wherein, as the external additive, the electrostatic image developer contains plate-shaped zinc oxide fine particles having an average longer length of 50 to 2,000 nm and a value S of 0.0001 to 0.03 $nm^{-1}$, which is a value obtained by dividing the average thickness d of the particles by the average base area A of the particles, and the content of the plate-shaped zinc oxide fine particles is in the range from 0.05 to 1 part by mass, with respect to 100 parts by mass of the colored resin particles.

Hereinafter, the electrostatic image developer of the present invention (hereinafter may be referred to as "toner") will be described.

The toner of the present invention contains colored resin particles containing a binder resin and a colorant, and an external additive.

Hereinafter, the method for producing the colored resin particles used in the present invention, the colored resin particles obtained by the production method, the method for producing the toner of the present invention using the colored resin particles, and the toner of the present invention will be described in order.

1. Method for Producing Colored Resin Particles

Generally, methods for producing colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the present invention can be produced by employing the wet methods or the dry methods. The suspension polymerization method is preferable among the wet methods and is performed by the following processes.

(A) Suspension Polymerization Method (A-1) Preparation Process of Polymerizable Monomer Composition First, a polymerizable monomer, a colorant, and other additives such as a release agent, which are added if required, are mixed to prepare a polymerizable monomer composition. For example, a media type dispersing machine is used for the mixing upon preparing the polymerizable monomer composition.

In the present invention, the polymerizable monomer means a monomer having a polymerizable functional group, and the polymerizable monomer is polymerized to be a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylic acid esters or methacrylic acid esters are suitably used for the monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally in the range from 0.1 to 5 parts by mass, preferably from 0.3 to 2 parts by mass, with respect to 100 parts by mass of the monovinyl monomer.

Further, it is preferable to use a macromonomer as a part of the polymerizable monomer, since the balance of the shelf stability and low-temperature fixability of the toner to be obtained can be improved. The macromonomer is a reactive oligomer or polymer having a polymerizable carbon-carbon unsaturated double bond at the end of a polymer chain and generally having a number average molecular mass of 1,000 to 30,000. A preferable macromonomer is one capable of providing a polymer having a higher glass transition temperature (hereinafter may be referred to as "Tg") than a polymer obtained by the polymerization of the monovinyl monomer.

The macromonomer to be used is preferably in the range from 0.03 to 5 parts by mass, more preferably from 0.05 to 1 part by mass, with respect to 100 parts by mass of the monovinyl monomer.

In the present invention, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C. I. Pigment Violet 19.

In the present invention, these colorants can be used alone or in combination of two or more kinds. The amount of the colorant is preferably in the range from 1 to 10 parts by mass, with respect to 100 parts by mass of the monovinyl monomer.

In the present invention, to improve the charging ability of the toner, a charge control agent having positively charging ability or negatively charging ability is preferably used.

The charge control agent is not particularly limited, as long as it is one that is generally used as a charge control agent for toners. Among charge control agents, a charge control resin having positively charging ability or negatively charging ability is preferably used, since the charge control resin is highly compatible with the polymerizable monomer and can impart stable charging ability (charge stability) to the toner particles. From the viewpoint of obtaining a positively-chargeable toner, the charge control resin having positively charging ability is more preferably used. The toner of the present invention is preferably a positively-chargeable toner.

Examples of the charge control agent having positively charging ability include a nigrosine dye, a quaternary ammonium salt, a triaminotriphenylmethane compound, an imidazole compound, a polyamine resin preferably used as the charge control resin, a quaternary ammonium group-containing copolymer and a quaternary ammonium salt group-containing copolymer.

Examples of the charge control agent having negatively charging ability include: azo dyes containing metal such as Cr, Co, Al and Fe; metal salicylate compounds; metal alkylsalicylate compounds; and sulfonic acid group-containing copolymers, sulfonic acid base-containing copolymers, carboxylic acid group-containing copolymers and carboxylic acid base-containing copolymers, which are preferably used as the charge control resin.

In the present invention, it is desirable that the amount of the charge control agent to be used is preferably in the range from 0.01 to 10 parts by mass, more preferably from 0.03 to 8 parts by mass, with respect to 100 parts by mass of the monovinyl monomer. When the added amount of the charge control agent is less than 0.01 part by mass, fog may occur. On the other hand, when the added amount of the charge control agent exceeds 10 parts by mass, printing soiling may occur.

From the viewpoint of improving the releasing characteristics of the toner from a fixing roller at fixing, a release agent is preferably added to the polymerizable monomer composition. The release agent can be used without any particular limitation, as long as it is one that is generally used as a release agent for toners.

The release agent preferably contains at least one of an ester wax and a hydrocarbon wax. By using the waxes as the release agent, the balance of low-temperature fixability and shelf stability can be improved.

In the present invention, the ester wax which is suitably used as the release agent is preferably a polyfunctional ester wax. For example, there may be mentioned: pentaerythritol ester compounds such as pentaerythritol tetrapalmitate, pentaerythritol tetrabehenate and pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate and glycerin tribehenate; and dipentaerythritol ester compounds such as dipentaerythritol hexamyristate and dipentaerythritol hexapalmitate.

Examples of the hydrocarbon wax suitably used as the release agent in the present invention include a polyethylene wax, a polypropylene wax, a Fischer-Tropsch wax, a petroleum wax and the like. Preferred are a Fischer-Tropsch wax and a petroleum wax, and more preferred is a petroleum wax.

The number average molecular mass of the hydrocarbon wax is preferably in the range from 300 to 800, more preferably from 400 to 600. The penetration of the hydrocarbon wax measured with reference to JIS K2235 5.4 is preferably in the range from 1 to 10, more preferably from 2 to 7.

In addition to the above release agents, natural waxes such as jojoba and mineral waxes such as ozokerite can be used, for example.

These release agents may be used alone or in combination of two or more kinds.

The amount of the release agent to be used is preferably in the range from 0.1 to 30 parts by mass, more preferably from 1 to 20 parts by mass, with respect to 100 parts by mass of the monovinyl monomer.

As one of other additives, a molecular weight modifier is preferably used upon the polymerization of the polymerizable monomer which is polymerized into a binder resin.

The molecular weight modifier is not particularly limited, as long as it is one that is generally used as a molecular weight modifier for toners. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by mass, more preferably from 0.1 to 5 parts by mass, with respect to 100 parts by mass of the monovinyl monomer.

(A-2) Suspension Process of Obtaining Suspension (Droplets Forming Process)

In the present invention, the polymerizable monomer composition containing at least a polymerizable monomer and a colorant is dispersed in an aqueous medium containing a dispersion stabilizer, and a polymerization initiator is added therein. Then, the droplets of the polymerizable monomer composition are formed. The method for forming the droplets is not particularly limited. For example, the droplets are formed by means of a device capable of strong agitation, such as an (in-line type) emulsifying and dispersing machine (product name: MILDER; manufactured by Pacific Machinery & Engineering Co., Ltd.) and a high-speed emulsifying and dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxy diethylacetate, t-hexylperoxy-2-ethylbutanoate, diisopropylperoxydicarbonate, di-t-butylperoxyisophthalate and t-butylperoxyisobutyrate. They can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e., peroxy esters having no aromatic ring, since they have excellent initiator efficiency and can reduce residual polymerizable monomer.

The polymerization initiator may be added after dispersing the polymerizable monomer composition into the aqueous medium and before forming droplets as described above, or may be added to the polymerizable monomer composition before the polymerizable monomer composition is dispersed in the aqueous medium.

The added amount of the polymerization initiator used for the polymerization of the polymerizable monomer composition is preferably in the range from 0.1 to 20 parts by mass, more preferably from 0.3 to 15 parts by mass, even more preferably from 1 to 10 parts by mass, with respect to 100 parts by mass of the monovinyl monomer.

In the present invention, the aqueous medium means a medium containing water as a main component.

In the present invention, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Among the above dispersion stabilizers, colloids of inorganic compounds, particularly a colloid of a hardly water-soluble metal hydroxide, is preferable. By using a colloid of an inorganic compound, particularly a colloid of a hardly water-soluble metal hydroxide, the colored resin particles can have a small particle size distribution, and the amount of the dispersion stabilizer remaining after washing can be small, so that the toner thus obtained can clearly reproduce an image and has excellent environmental stability.

(A-3) Polymerization Process

Formation of the droplets is carried out as described under the above (A-2). The thus-obtained aqueous dispersion medium is heated to polymerize, thereby forming an aqueous dispersion of colored resin particles.

The polymerization temperature of the polymerizable monomer composition is preferably 50° C. or more, more preferably in the range from 60 to 95° C. The polymerization reaction time is preferably in the range from 1 to 20 hours, more preferably in the range from 2 to 15 hours.

The colored resin particles may be mixed with an external additive and used as a polymerized toner. It is preferable that the colored resin particles are so-called core-shell type (or "capsule type") colored resin particles obtained by using the colored resin particles as a core layer each and forming a shell layer, which is a layer that is different from the core layer, around the core layer. The core-shell type colored resin particles can take a balance of lowering of fixing temperature and prevention of blocking at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

Hereinafter, a method for producing the core-shell type colored resin particles according to the in situ polymerization method will be described.

The core-shell type colored resin particles can be obtained by adding a polymerizable monomer for forming a shell layer (a polymerizable monomer for shell) and a polymerization initiator to an aqueous medium in which the colored resin particles are dispersed, and then polymerizing the mixture.

As the polymerizable monomer for shell, the above-mentioned polymerizable monomers can be used. Among the polymerizable monomers, it is preferable to use monomers which can provide a polymer having a Tg of more than 80° C., such as styrene, acrylonitrile and methyl methacrylate, alone or in combination of two or more kinds.

Examples of the polymerization initiator used for polymerization of the polymerizable monomer for shell include water-soluble polymerization initiators including: metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)2-hydroxyethyl) propionamide). These polymerization initiators can be used alone or in combination of two or more kinds. The amount of the polymerization initiator is preferably in the range from 0.1 to 30 parts by mass, more preferably from 1 to 20 parts by mass, with respect to 100 parts by mass of the polymerizable monomer for shell.

The polymerization temperature of the shell layer is preferably 50° C. or more, more preferably in the range from 60 to 95° C. The polymerization reaction time is preferably in the range from 1 to 20 hours, more preferably from 2 to 15 hours.

(A-4) Processes of Washing, Filtering, Dehydrating and Drying

It is preferable that after the polymerization, the aqueous dispersion of the colored resin particles obtained by the polymerization is subjected to operations including filtering, washing for removing the dispersion stabilizer, dehydrating and drying several times as needed, according to any conventional method.

In the washing method, when the inorganic compound is used as the dispersion stabilizer, it is preferable to add acid or alkali to the aqueous dispersion of the colored resin particles, thereby dissolving the dispersion stabilizer in water and removing it. When the colloid of the hardly water-soluble inorganic hydroxide is used as the dispersion stabilizer, it is preferable to control the pH of the aqueous dispersion of the colored resin particles to 6.5 or less by adding acid. Examples of the acid to be added include inorganic acids such as sulfuric acid, hydrochloric acid and nitric acid, and organic acids such as formic acid and acetic acid. Particularly, sulfuric acid is suitable for its high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization Method

In the case of producing the colored resin particles by employing the pulverization method, the colored resin particles are produced by the following processes.

First, a binder resin, a colorant, and other additives such as a release agent, which are added if required, are mixed by means of a mixer such as a ball mill, a V type mixer, an FM Mixer (product name), a high-speed dissolver, an internal mixer or the like. Next, the thus-obtained mixture is kneaded while heating by means of a press kneader, a twin screw kneading machine, a roller or the like. The obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into a desired particle diameter by means of a classifier such as a wind classifier or an airflow classifier, thereby obtaining the colored resin particles produced by the pulverization method.

In the pulverization method, those that are used under the above "(A) Suspension polymerization method", that is, the binder resin, the colorant, and the additives added if required, such as the release agent, can be used. Similarly to the colored resin particles obtained under the above "(A) Suspension polymerization method", the colored resin particles obtained by the pulverization method can be core-shell type colored resin particles by a method such as the in situ polymerization method.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the production method such as the above-mentioned "(A) Suspension polymerization method" or "(B) Pulverization method".

Hereinafter, the colored resin particles constituting the toner will be described. The below-mentioned colored resin particles encompass both core-shell type colored resin particles and colored resin particles which are not core-shell type.

The volume average particle diameter (Dv) of the colored resin particles is preferably in the range from 4 to 12 μm, more preferably from 5 to 10 μm. When the volume average particle diameter (Dv) of the colored resin particles is less than 4 μm, the flowability of the toner may lower and deteriorate transferability or decrease image density. When the volume average particle diameter (Dv) of the colored resin particles exceeds 12 μm, the resolution of images may decrease.

As for the colored resin particles, the ratio (Dv/Dn) of the volume average particle diameter (Dv) and the number average particle diameter (Dn) is preferably in the range from 1.0 to 1.3, more preferably from 1.0 to 1.2. When the ratio Dv/Dn exceeds 1.3, there may be a decrease in transferability, image density and resolution. The volume average particle diameter and the number average particle diameter of the colored resin particles can be measured by a particle diameter measuring device (product name: MULTISIZER; manufactured by: Beckman Coulter, Inc.), for example.

The average circularity of the colored resin particles of the present invention is preferably in the range from 0.96 to 1.00, more preferably from 0.97 to 1.00, even more preferably from 0.98 to 1.00, from the viewpoint of image reproducibility.

When the average circularity of the colored resin particles is less than 0.96, thin line reproducibility may deteriorate.

In the present invention, "circularity" is defined as a value which is obtained by dividing the perimeter of a circle having the same area as the projected area of a particle image by the perimeter of the particle image. Also in the present invention, "average circularity" is used as a simple method for quantitatively describing the shape of the particles and is an indicator that shows the degree of the surface roughness of the colored resin particles. The average circularity is 1 when the colored resin particles are perfectly spherical, and it gets smaller as the surface shape of the colored resin particles becomes more complex.

3. Production Method of Toner

In the present invention, the colored resin particles and the external additive are mixed and agitated to cover the colored resin particles with the external additive and attach the external additive to the surface of the colored resin particles, thereby obtaining a one-component toner (developer). The one-component toner can be further mixed with carrier particles and agitated to obtain a two-component developer.

In the present invention, as the external additive, the electrostatic image developer contains the plate-shaped zinc oxide fine particles having an average longer length of 50 to 2,000 nm. When the plate-shaped zinc oxide fine particles have an average longer length of less than 50 nm, initial fog can occur very easily in a high temperature and high humidity (H/H) environment. On the other hand, when the plate-shaped zinc oxide fine particles have an average longer length of more than 2,000 nm, printing durability decreases and, therefore, initial fog can occur very easily in a low temperature and low humidity (L/L) environment. Moreover, an after endurance conveyance amount becomes larger than an initial conveyance amount.

The plate-shaped zinc oxide fine particles more preferably have an average longer length of 80 to 1,200 nm, even more preferably 200 to 800 nm.

The longer length of the plate-shaped zinc oxide fine particles means the absolute maximum length of the base of the plate-shaped zinc oxide fine particles. In the present invention, the base of the plate-shaped zinc oxide fine particles indicates a plane having the largest surface area among the planes that constitute each of the plate-shaped zinc oxide fine particles. The average longer length means the average of the longer lengths.

The average longer length of the plate-shaped zinc oxide fine particles used in the present invention can be measured as follows, for example. First, the longer length of each plate-shaped zinc oxide fine particle is measured by a transmission electron microscope (TEM), a scanning electron microscope (SEM) or the like. The longer lengths of 30 or more of the plate-shaped zinc oxide fine particles are measured in this way, and the average is used as the average longer length of the plate-shaped zinc oxide fine particles.

The plate-shaped zinc oxide fine particles have a value S of 0.0001 to 0.03 $nm^{-1}$, which is a value obtained by dividing the average thickness d of the particles by the average base area A of the particles. When the plate-shaped zinc oxide fine particles have a value S of less than 0.0001 $nm^{-1}$, the plate-shaped zinc oxide fine particles become too thin. Therefore, the strength of the particles is reduced, and the particles cannot maintain the shape. As a result, the plate-shaped zinc oxide fine particles may not function as the external additive on the surface of the colored resin particles. When the plate-shaped zinc oxide fine particles have a value S of more than 0.03 $nm^{-1}$, the flatness of the plate-shaped zinc oxide fine particles is lost, so that the shape advantage of the plate-shaped zinc oxide fine particles is also lost. Therefore, the zinc oxide fine particles can be easily released from the toner particle surface and may deteriorate durability or generate severe fog in a low temperature and low humidity (L/L) environment.

The plate-shaped zinc oxide fine particles preferably have a value S of 0.0005 to 0.01 $nm^{-1}$, more preferably 0.001 to 0.002 $nm^{-1}$.

The thickness of the plate-shaped zinc oxide fine particles means a length that is approximately vertical to the base of the plate-shaped zinc oxide fine particles. The average thickness means the average of the thicknesses. The average base area of the plate-shaped zinc oxide fine particles means the average of the areas of the bases of the plate-shaped zinc oxide fine particles.

The average thickness d and the average base area A of the plate-shaped zinc oxide fine particles used in the present invention can be measured as follows, for example. First, each plate-shaped zinc oxide fine particle is photographed by a TEM, SEM or the like, and the thickness and base area is measured from the image thus obtained. The thicknesses and base areas of 30 or more of the plate-shaped zinc oxide fine particles are measured in this way, and the averages are used as the average thickness d and the average base area A of the plate-shaped zinc oxide fine particles.

The base area of the plate-shaped zinc oxide fine particles used in the present invention can be also measured as follows, for example. First, each plate-shaped zinc oxide fine particle is photographed by a TEM, SEM or the like, and the image thus obtained is analyzed by a commercially-available image analyzer (product name: LUZEX AP; manufactured by: Nireco Corporation) or the like to measure the base area. The base areas of 30 or more of the plate-shaped zinc oxide fine particles are measured in this way, and the average is used as the average base area A of the plate-shaped zinc oxide fine particles.

The value S can be calculated by dividing the average thickness d by the average base area A, which are calculated by the above methods, etc.

The shape of the base of the plate-shaped zinc oxide fine particles is not particularly limited and can be any polygonal shape. Of polygonal shapes, a hexagonal shape is preferred. When the plate-shaped zinc oxide fine particles are hexagonal plate-shaped zinc oxide fine particles, the base area A can be directly calculated from a microscopy image, such as an SEM image, by using the following formula ($A_1$) or ($A_2$), for example.

The FIGURE is a schematic perspective view of the hexagonal plate-shaped zinc oxide fine particles that are preferably used in the present invention. A hexagonal plate-shaped zinc oxide fine particle 100 (hereinafter may be referred to as particle 100) has a base area A and a thickness d. The FIGURE is a schematic view for explaining a calculation example of the base area A and is not necessarily a FIGURE that reflects the accurate size of the hexagonal plate-shaped zinc oxide fine particle.

A calculation example of the base area A is as follows. First, the absolute maximum length of the base of the particle 100 is used as a longer length L. In the particle 100, of diagonal lines connecting two opposite points, the length of the longest diagonal line is used as the longer length L. The length in an approximately vertical direction to the diagonal line is used as a width w of the particle 100. Using the diagonal line as a border, the width w is divided into $w_1$ and $w_2$. Also in the particle 100, given that two sides that do not share vertices with the diagonal line on the base are both approximately parallel to the diagonal line, the lengths of the two sides are used as shorter lengths $l_1$ and $l_2$ of the particle 100.

The base area A is obtained by the following formula ($A_1$), using the longer length L, the shorter lengths $l_1$ and $l_2$, $w_1$ and $w_2$.

$$\text{Base area } A=(L+l_1)\times w_1\times(1/2)+(L+l_2)\times w_2\times(1/2) \qquad \text{Formula } (A_1)$$

Given that $l_1$ and $l_2$ are both equal to the length l, the formula ($A_1$) is replaced by the formula ($A_2$):

$$\begin{aligned}\text{Base area } A &= (L+1)\times w_1\times(1/2)+(L+1)\times w_2\times(1/2) \qquad \text{Formula } (A_2)\\ &= (L+1)\times(w_1+w_2)\times(1/2)\\ &= (L+1)\times w\times(1/2)\end{aligned}$$

The plate-shaped zinc oxide fine particles preferably have a BET specific surface area of 1 to 50 $m^2/g$. When the BET specific surface area of the plate-shaped zinc oxide fine particles is less than 1 $m^2/g$, printing durability decreases, and initial fog can occur very easily in a low temperature and low humidity (L/L) environment. In addition, the after endurance conveyance amount may be larger than the initial conveyance amount. When the BET specific surface area of the plate-shaped zinc oxide fine particles is more than 50 $m^2/g$, initial fog may occur very easily in a high temperature and high humidity (H/H) environment.

The BET specific surface area of the plate-shaped zinc oxide fine particles is more preferably in the range from 2 to 40 $m^2/g$, even more preferably from 3 to 20 $m^2/g$.

To measure the BET specific surface area of the plate-shaped zinc oxide fine particles, conventionally-known methods can be used. A measurement example of the BET specific surface area of the plate-shaped zinc oxide fine particles is a method for measuring the BET specific surface area by a nitrogen adsorption method (the BET method) using an automatic BET specific surface area measuring device (product name: Macsorb HM model-1208; manufactured by: Mountech Co., Ltd.) or the like.

The content of the plate-shaped zinc oxide fine particles is preferably in the range from 0.05 to 1 part by mass, more preferably from 0.1 to 0.8 part my mass, even more preferably from 0.1 to 0.6 part by mass, with respect to 100 parts by mass of the colored resin particles. When the content of the plate-shaped zinc oxide fine particles is less than 0.05 part by mass, the addition of the plate-shaped zinc oxide fine particles is not sufficiently effective and may increase the difference between the initial conveyance amount and the after endurance conveyance amount. On the other hand, when the content of the plate-shaped zinc oxide fine particles is more than 1 part by mass, poor low-temperature fixability may be obtained.

Depending on the type and content of other additives, other covering conditions, etc., as the content of the plate-shaped zinc oxide fine particles increases, printing durability increases and the difference between the initial conveyance amount and the after endurance conveyance amount decreases. On the other hand, as the content of the plate-shaped zinc oxide fine particles decreases, low-temperature fixability tends to be better.

As the plate-shaped zinc oxide fine particles, various kinds of commercial products can be used. For example, there may be mentioned the following products manufactured by Sakai Chemical Industry Co., Ltd.: XZ-1000F (product name, hexagonal plate-shaped fine particles, average longer length: 1,200 nm, average thickness: 170 nm, average base area: 875,000 $nm^2$, value S: 0.0002 $nm^{-1}$, BET specific surface area: 2.3 $m^2/g$), XZ-500F (product name, hexagonal plate-shaped fine particles, average longer length: 450 nm, average thickness: 110 nm, average base area: 91,300 $nm^2$, value S: 0.0012 $nm^{-1}$, BET specific surface area: 3.3 $m^2/g$), XZ-300F (product name, hexagonal plate-shaped fine particles, average longer length: 350 nm, average thickness: 83 nm, average base area: 64,600 $nm^2$, value S: 0.0013 $nm^{-1}$, BET specific surface area: 4.9 $m^2/g$) and XZ-100F (product name, hexagonal plate-shaped fine particles, average longer length: 140 nm, average thickness: 35 nm, average base area: 9,970 $nm^2$, value S: 0.0035 $nm^{-1}$, BET specific surface area: 8.6 $m^2/g$.

In the present invention, it is preferable that as the external additive, the electrostatic image developer further contains inorganic fine particles A having a number average primary particle diameter of 36 to 200 nm.

When the number average primary particle diameter of the inorganic fine particles A is less than 36 nm, a decrease in spacer effect is caused and results in adverse effects on printing performance, such as a generation of fog. On the other hand, when the number average primary particle diameter of the inorganic fine particles A is more than 200 nm, the inorganic fine particles A can be easily released from the surface of the toner particles, so that the function of the inorganic fine particles A as the external additive decreases and results in adverse effects on printing performance.

The inorganic fine particles A preferably have a number average primary particle diameter of 40 to 150 nm, more preferably 45 to 100 nm.

The number average primary particle diameters of the inorganic fine particles A, the inorganic fine particles B and the fatty acid metal salt fine particles, which are fine particles that are preferably used in the present invention, can be measured as follows, for example. First, the particle diameters of the particles of the external additives are measured by a TEM, SEM or the like. The particle diameters of 30 or more of the external additive particles are measured in this way, and the average is used as the number average primary particle diameter of the particles.

As a different method for measuring the number average primary particle diameter of the external additives used in the present invention, for example, there may be mentioned a method for measuring the number average primary particle diameter by dispersing the external additive particles in a dispersion medium such as water and measuring the dispersion with a particle size analyzer (product name: MICROTRAC 3300EX II; manufactured by: Nikkiso Co., Ltd.)

As the inorganic fine particles A, there may be mentioned inorganic fine particles made of silica, titanium oxide, aluminum oxide, tin oxide, calcium carbonate, calcium phosphate, cerium oxide or a mixture of these inorganic matters, for example. Of them, silica fine particles and titanium oxide fine particles are preferred, and silica fine particles are more preferred.

The content of the inorganic fine particles A is preferably in the range from 0.1 to 3 parts by mass, more preferably from 0.2 to 2 parts by mass, even more preferably from 0.3 to 1.5 parts by mass, with respect to 100 parts by mass of the colored resin particles.

When the content of the inorganic fine particles A is less than 0.1 part by mass, the function of the inorganic fine particles A as the external additive cannot be sufficiently exhibited and may result in adverse effects on printing performance. On the other hand, when the content of the inorganic fine particles A is more than 3 parts by mass, the inorganic fine particles A can be easily released from the surface of the toner particles, so that the function of the inorganic fine particles A as the external additive may decrease and result in adverse effects on printing performance.

It is preferable that the inorganic fine particles A are particles subjected to a hydrophobicity-imparting treatment. In this case, as the hydrophobicity-imparting treatment agent, there may be mentioned a silane coupling agent, silicone oil, fatty acid or a metal salt of fatty acid, for example. From the viewpoint of obtaining high image quality, a silane coupling agent and silicone oil are preferred.

Examples of the silane coupling agent include disilazanes such as hexamethyldisilazane; cyclic silazanes; alkylsilane compounds such as trimethylsilane, trimethylchlorosilane, dimethyldichlorosilane, methyltrichlorosilane, allyl dimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane and vinyltriacetoxysilane; and aminosilane compounds such as γ-aminopropyltriethoxysilane, γ-(2-aminoethyl) aminopropyltrimethoxysilane, γ-(2-aminoethyl) aminopropylmethyldimethoxysilane, aminosilane, N-(2-aminoethyl)3-aminopropyltrimethoxysilane and N-β-(N-vinylbenzylaminoethyl)-γ-aminopropyltrimethoxysilane.

Examples of the silicone oil include dimethyl polysiloxane, methyl hydrogen polysiloxane, methylphenylpolysiloxane and amino-modified silicone oil.

These hydrophobicity-imparting treatment agents can be used alone or in combination of two or more kinds.

In the case of obtaining a positively chargeable developer, it is more preferable to use a silicon compound containing an amino group, such as an aminosilane compound or an amino-modified silicone oil, since a developer having excellent positively charging ability can be easily obtained.

As the inorganic fine particles A, various kinds of commercial products can be used. The examples include VPNA50H (product name; manufactured by Nippon Aerosil Co., Ltd.; number average primary particle diameter: 40 nm), HDK H05TA (product name; manufactured by Clariant Corp.; number average primary particle diameter: 50 nm), and HDK H05TX (product name; manufactured by Clariant Corp.; number average primary particle diameter: 50 nm).

In the present invention, it is preferable that as the external additive, the electrostatic image developer further contains inorganic fine particles B having a number average primary particle diameter of 7 to 35 nm. When the number average primary particle diameter of the inorganic fine particles B is less than 7 nm, the inorganic fine particles B cannot stay on the surface of the colored resin particles and can be easily buried into the colored resin particles. Therefore, sufficient flowability cannot be imparted to the toner particles and may result in adverse effects on printing performance. On the other hand, when the number average primary particle diameter of the inorganic fine particles B is more than 35 nm, the ratio (coverage) of the inorganic fine particles B covering the surface of each toner particle decreases, so that sufficient flowability may not be imparted to the toner particles.

The number average primary particle diameter of the inorganic fine particles B is more preferably in the range from to 30 nm. The inorganic fine particles B are preferably particles subjected to a hydrophobicity-imparting treatment. In this case, as the hydrophobicity-imparting treatment agent, there may be used the same agent as that used in the inorganic fine particles A.

As the inorganic fine particles B, there may be mentioned inorganic fine particles made of silica, titanium oxide, aluminum oxide, tin oxide, calcium carbonate, calcium phosphate, cerium oxide or a mixture of these inorganic substances, for example. Of them, silica fine particles and titanium oxide fine particles are preferred, and silica fine particles are more preferred.

The content of the inorganic fine particles B is preferably 0.1 to 2 parts by mass, more preferably 0.2 to 1.5 parts by mass, even more preferably 0.4 to 1.2 parts by mass, with respect to 100 parts by mass of the colored resin particles.

When the content of the inorganic fine particles B is less than 0.1 part by mass, the function of the inorganic fine particles B as the external additive cannot be sufficiently exhibited and may decrease flowability or decrease storage stability or durability. On the other hand, when the content of the inorganic fine particles B is more than 2 parts by mass, the inorganic fine particles B can be easily released from the surface of the toner particles and may decrease charging ability in a high temperature and high humidity environment and generate fog.

As the inorganic fine particles B, various kinds of commercial products can be used. The examples include: HDK2150 (product name, number average primary particle diameter: 12 nm) manufactured by Clariant Corp.; NA50Y (product name, number average primary particle diameter: 35 nm), R504 (product name, number average primary particle diameter: 12 nm), RA200HS (product name, number average primary particle diameter: 12 nm), and RX300 (product name, number average primary particle diameter: 7 nm) manufactured by Nippon Aerosil Co., Ltd.; MSP-012 (product name, number average primary particle diameter: 16 nm) and MSP-013 (product name, number average primary particle diameter: 12 nm) manufactured by Tayca Corporation; and TG-7120 (product name, number average primary particle diameter: 20 nm) and TG-820F (product name, number average primary particle diameter: 7 nm) manufactured by Cabot Corporation.

The toner of the present invention can contain either the inorganic fine particles A or the inorganic fine particles B. It is more preferable that the toner of the present invention contains both the inorganic fine particles A and the inorganic fine particles B.

In the present invention, it is preferable that as the external additive, the electrostatic image developer further contains fatty acid metal salt fine particles having a number average primary particle diameter of 0.05 to 5 μm. When the number average primary particle diameter of the fatty acid metal salt fine particles is less than 0.05 μm, the charging ability of the toner may decrease and generate fog. On the other hand, when the number average primary particle diameter of the fatty acid metal salt fine particles is more than 5 μm, white spots may be generated on a printed image.

The number average primary particle diameter of the fatty acid metal salt fine particles is preferably 0.1 to 3 μm, more preferably 0.3 to 2 μm, even more preferably 0.4 to 0.9 μm.

As the metal constituting the fatty acid metal salt, there may be mentioned Li, Na, K, Rb, Cs, Be, Mg, Ca, Sr, Ba and Zn, for example.

The fatty acid (R—COOH) which corresponds to the fatty acid site ($R—COO^-$) of the fatty acid metal salt encompasses, of carboxylic acids (R—COOH) having a carboxyl group (—COOH), all carboxylic acids having a chain structure. In the present invention, the fatty acid site is preferably one derived from a higher fatty acid in which the alkyl group (R—) has a large number of carbons.

Examples of the higher fatty acid (R—COOH) include lauric acid ($CH_3(CH_2)_{10}COOH$), tridecanoic acid ($CH_3(CH_2)_{11}COOH$), myristic acid ($CH_3(CH_2)_{12}COOH$), pentadecanoic acid ($CH_3(CH_2)_{13}COOH$), palmitic acid ($CH_3(CH_2)_{14}COOH$), heptadecanoic acid ($CH_3(CH_2)_{15}COOH$), stearic acid ($CH_3(CH_2)_{16}COOH$), arachidic acid ($CH_3(CH_2)_{18}COOH$), behenic acid ($CH_3(CH_2)_{20}COOH$) and lignoceric acid ($CH_3(CH_2)_{22}COOH$).

Typical concrete examples of the fatty acid metal salt include: metal laurates such as lithium laurate, sodium laurate, potassium laurate, magnesium laurate, calcium laurate and barium laurate; metal myristates such as lithium myristate, sodium myristate, potassium myristate, magnesium myristate, calcium myristate and barium myristate; metal palmitates such as lithium palmitate, sodium palmitate, potassium palmitate, magnesium palmitate, calcium palmitate and barium palmitate; and metal stearates such as lithium stearate, sodium stearate, potassium stearate, magnesium stearate, calcium stearate, barium stearate and zinc stearate. Of them, metal stearates are preferred, and zinc stearate is more preferred.

As the fatty acid metal salt particles, various kinds of commercial products can be used. The examples include the following products manufactured by Sakai Chemical Industry Co., Ltd.: SPL-100F (product name, lithium stearate, number average primary particle diameter 0.71 μm), SPX-100F (product name, magnesium stearate, number average primary particle diameter 0.72 μm), SPC-100F (product name, calcium stearate, number average primary particle diameter 0.51 μm) and SPZ-100F (product name, zinc stearate, number average primary particle diameter 0.5 μm).

The agitator used to cover the colored resin particles with the external additives is not particularly limited, as long as it is an agitating device that is able to attach the external additives to the surface of the colored resin particles. For example, the colored resin particles can be covered with the external additives by using a agitator that is capable of mixing and agitation, such as FM Mixer (product name; manufactured by: Nippon Coke & Engineering Co., Ltd.), Super Mixer (product name; manufactured by: Kawata Manufacturing Co., Ltd.), Q Mixer (product name; Nippon Coke & Engineering Co., Ltd.), Mechanofusion System (product name; manufactured by: Hosokawa Micron Corporation) and Mechanomill (product name; manufactured by: Okada Seiko Co., Ltd.)

4. Toner of the Present Invention

The toner of the present invention is a toner which is able to exhibit excellent low-temperature fixability, which is able to maintain a toner conveyance amount that is almost the same as the beginning of printing even during continuous printing, and which is less likely to cause initial fog in both a high temperature and high humidity (H/H) environment and a low temperature and low humidity (L/L) environment.

EXAMPLES

Hereinafter, the present invention will be described further in detail, with reference to examples and comparative examples. However, the scope of the present invention may not be limited to the following examples. Herein, "part(s)" and "%" are based on mass if not particularly mentioned.

Test methods used in the examples and the comparative examples are as follows.

1. Production of Electrostatic Image Developer

Example 1

First, 75 parts of styrene and 25 parts of n-butyl acrylate as polymerizable monomers, and 5 parts of carbon black (product name: #25B; manufactured by: Mitsubishi Chemical Corporation) as a black colorant were dispersed by a media type emulsifying and dispersing machine to obtain a polymerizable monomer mixture.

To the polymerizable monomer mixture, 1 part of a charge control resin (product name: Acrybase FCA-161P; manufactured by: Fujikura Kasei Co., Ltd.) as a charge control agent, 5 parts of an ester wax (product name: WEPT; manufactured by: NOF Corporation) as a release agent, 0.3 part of a polymethacrylic acid ester macromonomer (product name: AA6; manufactured by: Toagosei Co., Ltd.) as a macromonomer, 0.6 part of divinylbenzene as a crosslinkable polymerizable monomer, and 1.6 parts of t-dodecyl mercaptan as a molecular weight modifier were added, mixed and then dissolved to prepare a polymerizable monomer composition.

Separately, an aqueous solution of 6.2 parts of sodium hydroxide (alkali metal hydroxide) dissolved in 50 parts of ion-exchanged water was gradually added to an aqueous solution of 10.2 parts of magnesium chloride (water-soluble polyvalent metal salt) dissolved in 250 parts of ion-exchanged water, while agitating at room temperature, to prepare a magnesium hydroxide colloid (a hardly water-soluble metal hydroxide colloid) dispersion.

After the polymerizable monomer composition was put in the above-obtained magnesium hydroxide colloid dispersion and agitated at room temperature, 4.4 parts of t-butylperoxy-2-ethylhexanoate (product name: PERBUTYL O; manufactured by: NOF Corporation) was added therein as a polymerization initiator. Then, the resultant mixture was dispersed by high shear agitation at 15,000 rpm for 10 minutes, using an in-line type emulsifying and dispersing machine, thereby forming droplets of the polymerizable monomer composition.

The suspension having the above-obtained droplets of the polymerization monomer composition dispersed therein (a polymerizable monomer composition dispersion) was charged into a reactor furnished with an agitating blade, and the temperature thereof was raised to 90° C. to start a polymerization reaction. When the polymerization conversion rate reached almost 100%, 1 part of methyl methacrylate (a polymerizable monomer for shell) and 0.3 part of 2,2'-azobis (2-methyl-N-(2-hydroxyethyl)-propionamide) (a water-soluble polymerization initiator for shell; product name: VA-086; manufactured by: Wako Pure Chemical Industries, Ltd.) dissolved in 10 parts of ion-exchanged water were added. After continuing the reaction for another 4 hours at 90° C., the reactor was cooled by water to stop the reaction. Thus, an aqueous dispersion of colored resin particles having a core-shell structure was obtained.

The above-obtained aqueous dispersion of colored resin particles was subjected to acid washing in which, while agitating at room temperature, sulfuric acid was added dropwise until the pH of the aqueous dispersion was 6.5 or less. Then, the aqueous dispersion was subjected to filtration separation, and the thus-obtained solid was re-slurried with 500 parts of ion-exchanged water, and a water washing treatment (washing, filtration and dehydration) was carried out thereon several times. Next, filtration separation was carried out thereon, and the thus-obtained solid was placed in the container of a dryer and dried at 45° C. for 48 hours, thereby obtaining colored resin particles having a volume average particle diameter (Dv) of 7.8 μm, a number average particle diameter (Dn) of 6.9 μm, a particle size distribution (Dv/Dn) of 1.13, and an average circularity of 0.987.

To 100 parts of the above-obtained colored resin particles, the following external additives were added: 0.2 part of plate-shaped zinc oxide fine particles 1 (product name: XZ-500F, manufactured by: Sakai Chemical Industry Co., Ltd., hexagonal plate-shaped fine particles, average longer length: 450 nm, average thickness: 110 nm, average base area: 91,300 $nm^2$, value S: 0.0012 $nm^{-1}$, BET specific surface area: 3.3 $m^2/g$), 1 part of silica fine particles a (product name: HDK HO5TA, manufactured by: Clariant Corporation, number average primary particle diameter: 50 nm) as the inorganic fine particles A, 0.8 part of silica fine particles b (product name: TG-7120, manufactured by: Cabot Corporation, number average primary particle diameter: 20 nm) as the inorganic fine particles B, and 0.1 part of zinc stearate fine particles (product name: SPZ-100F, manufactured by: Sakai Chemical Industry Co., Ltd., number average primary particle diameter: 0.5 μm) as the fatty acid metal salt fine particles. They were mixed and agitated by a high-speed agitator (product name: FM Mixer, manufactured by: Nippon Coke & Engineering Co., Ltd.) at an agitating blade peripheral speed of 40 m/sec and for a treatment time of 300 seconds to cover the colored resin particles with the external additives, thereby obtaining the electrostatic image developer of Example 1. Test results are shown in Table 1.

Example 2

The electrostatic image developer of Example 2 was produced and tested in the same manner as Example 1, except that the amount of the added plate-shaped zinc oxide fine particles 1 was changed from 0.2 part to 0.4 part, and the zinc stearate fine particles were not added.

Example 3

The electrostatic image developer of Example 3 was produced and tested in the same manner as Example 1, except that the amount of the added plate-shaped zinc oxide fine particles 1 was changed from 0.2 part to 0.1 part, and the zinc stearate fine particles were not added.

Example 4

The electrostatic image developer of Example 4 was produced and tested in the same manner as Example 1, except that 0.2 part of plate-shaped zinc oxide fine particles 2 (product name: XZ-1000F, manufactured by: Sakai Chemical Industry Co., Ltd., hexagonal plate-shaped fine particles, average longer length: 1,200 nm, average thickness: 170 nm, average base area: 875,000 $nm^2$, value S: 0.0002 $nm^{-1}$, BET specific surface area: 2.3 $m^2/g$) were added in place of 0.2 part of the plate-shaped zinc oxide fine particles 1 (product name: XZ-500F, manufactured by: Sakai Chemical Industry Co., Ltd., hexagonal plate-shaped fine particles, average longer length: 450 nm, average thickness: 110 nm, average base area: 91,300 $nm^2$, value S: 0.0012 $nm^{-1}$, BET specific surface area: 3.3 $m^2/g$), and the zinc stearate fine particles were not added.

Example 5

The electrostatic image developer of Example 5 was produced and tested in the same manner as Example 1, except that 0.2 part of plate-shaped zinc oxide fine particles 3 (product name: XZ-300F, manufactured by: Sakai Chemical Industry Co., Ltd., hexagonal plate-shaped fine particles, average longer length: 350 nm, average thickness: 83 nm, average base area: 64,600 $nm^2$, value S: 0.0013 $nm^{-1}$, BET specific surface area: 4.9 $m^2/g$) were added in place of 0.2 part of the plate-shaped zinc oxide fine particles 1 (product name: XZ-500F, manufactured by: Sakai Chemical Industry Co., Ltd., hexagonal plate-shaped fine particles, average longer length: 450 nm, average thickness: 110 nm, average base area: 91,300 $nm^2$, value S: 0.0012 $nm^{-1}$, BET specific surface area: 3.3 $m^2/g$), and the zinc stearate fine particles were not added.

Example 6

The electrostatic image developer of Example 6 was produced and tested in the same manner as Example 1, except that 0.2 part of plate-shaped zinc oxide fine particles 4 (product name: XZ-100F, manufactured by: Sakai Chemical Industry Co., Ltd., hexagonal plate-shaped fine particles, average longer length: 140 nm, average thickness: 35 nm, average base area: 9,970 $nm^2$, value S: 0.0035 $nm^{-1}$, BET specific surface area: 8.6 $m^2/g$) were added in place of 0.2 part of the plate-shaped zinc oxide fine particles 1 (product name: XZ-500F, manufactured by: Sakai Chemical Industry Co., Ltd., hexagonal plate-shaped fine particles, average longer length: 450 nm, average thickness: 110 nm, average base area: 91,300 $nm^2$, value S: 0.0012 $nm^{-1}$, BET specific surface area: 3.3 $m^2/g$), and the zinc stearate fine particles were not added.

Comparative Example 1

The electrostatic image developer of Comparative Example 1 was produced and tested in the same manner as Example 1, except that the plate-shaped zinc oxide fine particles 1 were not added.

Comparative Example 2

The electrostatic image developer of Comparative Example was produced and tested in the same manner as Example 1, except that the plate-shaped zinc oxide fine particles 1 and the zinc stearate fine particles were not added.

Comparative Example 3

The electrostatic image developer of Comparative Example was produced and tested in the same manner as Example 1, except that 0.2 part of zinc oxide fine particles 5 (product name: NanoTek ZnO, manufactured by: C. I. Kasei Company, Limited, irregularly-shaped fine particles, average particle diameter: 34 nm, BET specific surface area: 30 $m^2/g$) were added in place of 0.2 part of the plate-shaped zinc oxide fine particles 1 (product name: XZ-500F, manufactured by: Sakai Chemical Industry Co., Ltd., hexagonal plate-shaped fine particles, average longer length: 450 nm, average thickness: 110 nm, average base area: 91,300 $nm^2$, value S: 0.0012 $nm^{-1}$, BET specific surface area: 3.3 $m^2/g$).

Comparative Example 4

The electrostatic image developer of Comparative Example 4 was produced and tested in the same manner as Example 1, except that 0.2 part of zinc oxide fine particles 6 (product name: Zinc Oxide 23-K, manufactured by: HakusuiTech Co., Ltd., irregularly-shaped fine particles, average particle diameter: 200 nm, BET specific surface area: 4 to 10 $m^2/g$) were added in place of 0.2 part of the plate-shaped zinc oxide fine particles (product name: XZ-500F, manufactured by: Sakai Chemical Industry Co., Ltd., hexagonal plate-shaped fine particles, average longer length: 450 nm, average thickness: 110 nm, average base area: 91,300 $nm^2$, value S: 0.0012 $nm^{-1}$, BET specific surface area: 3.3 $m^2/g$).

2. Evaluation of Electrostatic Image Developers

For the electrostatic image developers of Examples 1 to 6 and Comparative Examples 1 to 4, the properties of the external additives, the properties of the colored resin particles, and the fixability and printing properties of the toners were measured. The details are as follows.

2-1. Properties of External Additives (a) Measurement of Value S of Plate-shaped Zinc Oxide Fine Particles (=Average Thickness d/Average Base Area A)

The plate-shaped zinc oxide fine particles 1 to 4 were measured as follows.

An SEM image of each zinc oxide fine particles was taken by an ultra-high resolution field emission scanning electron microscope (product name: SU9000; manufactured by: Hitachi High-Technologies Corporation). Of the taken images, 30 particles were randomly selected. For each selected particle, a plane having the largest surface area was used as the base of the particle and the area (base area) was measured. Also, a length that is approximately vertical to the base was measured and used as the thickness. From the base areas and thicknesses of the 30 particles, the average base area A and the average thickness d were calculated. The calculated average thickness d was divided by the average base area A, thereby calculating the value S (=average thickness d/average base area A) of the plate-shaped zinc oxide fine particles.

(b) Measurement of BET Specific Surface Area

The BET specific surface areas of the plate-shaped zinc oxide fine particles 1 to 4 and the zinc oxide fine particles 5 and 6 were measured by a nitrogen adsorption method (the BET method) using an automatic BET specific surface area measuring device (product name: Macsorb HM model-1208; manufactured by: Mountech Co., Ltd.)

2-2. Properties of Colored Resin Particles (a) Volume Average Particle Diameter (Dv), Number Average Particle Diameter (Dn) and Particle Size Distribution (Dv/Dn) of Colored Resin Particles About 0.1 g of the measurement sample (colored resin particles) was put in a beaker. An alkylbenzene sulfonic acid aqueous solution (product name: Driwel; manufactured by: Fujifilm Corporation) of 0.1 mL was added thereto, which serves as a dispersant. In addition, 10 to 30 mL of Isoton II was put in the beaker. The mixture was dispersed for 3 minutes with a W (watt) ultrasonic disperser. Then, the volume average particle diameter (Dv) and number average particle diameter (Dn) of the colored resin particles were measured with a particle diameter measuring device (product name: Multisizer; manufactured by: Beckman Coulter, Inc.) in the following condition, followed by calculation of the particle size distribution (Dv/Dn).

Aperture diameter: 100 μm

Medium: Isoton II

Number of measured particles: 100,000 particles (b) Average Circularity of Colored Resin Particles First, 10 mL of ion-exchanged water was put in a container. Then, 0.02 g of a surfactant (alkylbenzene sulfonic acid) was added thereto, which serves as a dispersant. In addition, 0.02 g of the measurement sample (colored resin particles) was added thereto. The mixture was subjected to dispersion treatment for 3 minutes with an ultrasonic disperser at 60 W (watt). The resultant was adjusted so as to have a colored resin particle concentration of 3,000 to 10,000 particles/μL at the time of measurement. Of the colored resin particles, 1,000 to 10,000 particles of 0.4 μm or more by a diameter of the equivalent circle were measured with a flow particle image analyzer (product name: FPIA-2100; manufactured by: Sysmex Corporation). The average circularity was obtained from the measured values.

The circularity is expressed by the following calculation formula 1. The average circularity is the average of circularities measured by the calculation formula 1.

(Circularity)=(The perimeter of a circle having the same area as the projected area of a particle image)/(The perimeter of the projected particle image) Calculation Formula 1:

2-3. Toner Fixability (a) Fixing Temperature

A fixing test was carried out by using a commercially-available, non-magnetic one-component development printer (printing rate=20 sheets/min) which had been modified to be able to change the temperature of the fixing roller. In the fixing test, the temperature of the fixing roller of the modified printer was changed by 5° C., and every time the temperature was changed, the toner fixing rate at each temperature was measured.

The toner fixing rate was calculated from the ratio of image densities of a black solid area, which was printed on a test sheet by the modified printer, before and after subjected to a tape removal operation. More specifically, when the image density before the tape removal is referred to as "ID (before)" and the image density after the tape removal is referred to as "ID (after)", the toner fixing rate can be calculated by the following formula:

$$\text{Fixing rate (\%)}=(\text{ID (after)}/\text{ID (before)})\times 100$$

In particular, the tape removal is an operation having the steps of: attaching a piece of an adhesive tape (product name: Scotch Mending Tape 810-3-18; manufactured by: Sumitomo 3M Limited) to the measurement part (the black solid area) on the test sheet; firmly attaching the tape piece by pressing the piece at a given pressure; and then removing the tape piece at a constant speed in a direction along the sheet. Image density was measured with a reflection-type densitometer (product name: RD918; manufactured by: McBeth).

In this fixing test, the minimum fixing roller temperature at which the toner fixing rate is 80% or more, was referred to as the minimum fixing temperature of the toner.

2-4. Printing Properties of Toner (a) Printing Durability

In a printing durability test, a commercially-available, non-magnetic one-component development printer (printing speed: 20 A4 sheets/min) was used. The toner was charged into the toner cartridge of the development device, and then printing sheets were set in the device.

The printer was left for 24 hours in a normal temperature and normal humidity (N/N) environment (temperature: 23° C., humidity: 50%). Then, in the same environment, 15,000 sheets were continuously printed at an image density of 5%.

Solid pattern printing (image density 100%) was carried out every 500 sheets, and the resulting black solid images were measured for image density, by means of a reflection image densitometer (product name: RD918; manufactured by: Macbeth). Then, in addition, another solid pattern printing (image density 0%) was carried out. When printing halfway, the printer was stopped. A piece of an adhesive tape (product name: Scotch Mending Tape 810-3-18; manufactured by: Sumitomo 3M Limited) was attached to the toner in a non-image area on the photoconductor after development. Then, the tape piece was removed therefrom and attached to a printing sheet. Next, the whiteness degree (B) of the printing sheet on which the tape piece was attached, was measured with a whiteness colorimeter (product name: ND-1; manufactured by: Nippon Denshoku Industries Co., Ltd.) In the same manner, an unused piece of the adhesive tape was attached to the printing sheet, and the whiteness degree (A) was measured. The difference in whiteness degree (B-A) was used as the fog value. As the fog value gets smaller, fog preferably decreases.

The number of continuously printed sheets that could maintain such an image quality that the image density is 1.3 or more and the fog value is 3 or less, was measured. The printing durability required of the toner is that the number of the continuously printed sheets is 10,000 or more.

In Table 1, "15000<" indicates that such an image quality that the image density is 1.3 or more and the fog value is 3 or less, could be maintained even at the time of printing 15,000 sheets.

(b) Fog Test in High Temperature and High Humidity (H/H) Environment or Low Temperature and Low Humidity (L/L) Environment The above-described printer and the toners to be evaluated were left for one day in a high temperature and high humidity (H/H) environment (temperature: 35° C., humidity: 80%) or in a low temperature and low humidity (L/L) environment (temperature: 10° C., humidity: 20%) to measure fog.

In the fog test, first, solid pattern printing (image density 0%) was carried out. When printing halfway, the modified printer was stopped. A piece of an adhesive tape (product name: Scotch Mending Tape 810-3-18; manufactured by: Sumitomo 3M Limited) was attached to the toner in a non-image area on the photoconductor after development. The tape piece having the toner attached thereto was attached to a new printing sheet, and the whiteness degree (B) was measured with a whiteness colorimeter (manufactured by: Nippon Denshoku Industries Co., Ltd.)

In the same manner, as a reference, an unused piece of the adhesive tape was attached to the printing sheet, and the whiteness degree (A) was measured. The difference in whiteness degree (B-A) was used as the fog value. As the fog value gets smaller, fog preferably decreases.

(c) Measurement of Initial and after Endurance Conveyance Amounts (M/A)

Using the above-mentioned printer, a solid square pattern (50 mm×50 mm) was printed on a copy sheet, in a normal temperature and normal humidity (N/N) environment (temperature: 23° C., humidity: 50%).

An unfixed image was removed from the printer. The toner developed on the copy sheet was blown off by air. The conveyance amounts (M/A) were calculated by the following formula, using the masses of the copy sheet before and after the toner was blown off. The printing was carried out before the durability test, and the value then measured was used as the initial conveyance amount (M/A). The printing was carried out after the durability test, and the value then measured was used as the after endurance conveyance amount (M/A).

$$M/A\ (\mathrm{mg/cm^2}) = (W1 - W2)/25\ \mathrm{cm^2}$$

W1=The mass (mg) of the copy sheet before the toner was blown off.

W2=The mass (mg) of the copy sheet after the toner was blown off.

In Examples and Comparative Examples, the criterion of the initial conveyance amount (M/A) and the after endurance conveyance amount (M/A) are both 0.30 (mg/cm$^2$). The initial conveyance amount (M/A) and the after endurance conveyance amount (M/A) are both required to be 0.20 to 0.40 (mg/cm$^2$), preferably 0.25 to 0.35 (mg/cm$^2$).

The measurement and evaluation results of the electrostatic image developers of Examples 1 to 6 and Comparative Examples 1 to 4 are shown in Table 1, along with the average particle diameter and so on of the zinc oxide fine particles and those of the zinc stearate fine particles.

TABLE 1

| | | Example 1 | Example 2 | Example 3 | Example 4 | Example 5 | Example 6 |
|---|---|---|---|---|---|---|---|
| Zinc oxide fine particles | Type | Plate-shaped ZnO particles 1 | Plate-shaped ZnO particles 1 | Plate-shaped ZnO particles 1 | Plate-shaped ZnO particles 2 | Plate-shaped ZnO particles 3 | Plate-shaped ZnO particles 4 |
| | Shape | Hexagonal plate shape | Hexagonal plate shape | Hexagonal plate shape | Hexagonal plate shape | Hexagonal plate shape | Hexagonal plate shape |
| | Average longer length (nm) | 450 | 450 | 450 | 1200 | 350 | 140 |
| | Average thickness d (nm) | 110 | 110 | 110 | 170 | 83 | 35 |
| | Average base area A (nm$^2$) | 91300 | 91300 | 91300 | 875000 | 64600 | 9970 |
| | S (=d/A) (nm$^{-1}$) | 0.0012 | 0.0012 | 0.0012 | 0.0002 | 0.0013 | 0.0035 |
| | BET specific surface area (m$^2$/g) | 3.3 | 3.3 | 3.3 | 2.3 | 4.9 | 8.6 |
| | Added amount (part) | 0.2 | 0.4 | 0.1 | 0.2 | 0.2 | 0.2 |
| Fatty acid metal salt fine particles | Type | Zinc stearate particles | — | — | — | — | — |
| | Number average primary particle diameter (μm) | 0.5 | — | — | — | — | — |
| | Added amount (part) | 0.1 | — | — | — | — | — |
| Fixability | Minimum fixing temperature (° C.) | 150 | 155 | 150 | 150 | 155 | 155 |
| Printing properties | Number of printed sheets (NN) (sheets) | 15000 < | 15000 < | 14000 | 13000 | 15000 < | 15000 < |
| | Initial fog (LL) (—) | 0.3 | 0.2 | 0.7 | 1.2 | 0.2 | 0.2 |
| | Initial fog (HH) (—) | 0.2 | 1.0 | 0.2 | 0.2 | 0.6 | 1.1 |
| | Initial M/A (mg/cm$^2$) | 0.31 | 0.30 | 0.33 | 0.31 | 0.30 | 0.33 |
| | After endurance M/A (mg/cm$^2$) | 0.35 | 0.32 | 0.39 | 0.39 | 0.34 | 0.35 |

| | | Comparative Example 1 | Comparative Example 2 | Comparative Example 3 | Comparative Example 4 |
|---|---|---|---|---|---|
| Zinc oxide fine particles | Type | — | — | ZnO particles 5 | ZnO particles 6 |
| | Shape | — | — | Irregular shape | Irregular shape |
| | Average particle diameter | — | — | 34 | 200 |

TABLE 1-continued

| | | | | | |
|---|---|---|---|---|---|
| | (nm) | | | | |
| | BET specific surface area ($m^2/g$) | — | — | 30 | 4 to 10 |
| | Added amount (part) | — | — | 0.2 | 0.2 |
| Fatty acid metal salt fine particles | Type | Zinc stearate particles | — | — | — |
| | Number average primary particle diameter (μm) | 0.5 | — | — | — |
| | Added amount (part) | 0.1 | — | — | — |
| Fixability | Minimum fixing temperature (° C.) | 150 | 145 | 155 | 155 |
| Printing properties | Number of printed sheets (NN) (sheets) | 13000 | 9000 | 11000 | 10000 |
| | Initial fog (LL) (—) | 1.8 | 3.5 | 0.5 | 2.2 |
| | Initial fog (HH) (—) | 0.5 | 1.0 | 2.1 | 1.2 |
| | Initial M/A ($mg/cm^2$) | 0.36 | 0.30 | 0.31 | 0.34 |
| | After endurance M/A ($mg/cm^2$) | 0.53 | 0.62 | 0.40 | 0.41 |

3. Evaluation of Electrostatic Image Developers (Toners)

Hereinafter, the evaluation results of the toners will be discussed, with reference to Table 1.

According to Table 1, the toner of Comparative Example 1 is a toner that does not contain zinc oxide fine particles. According to Table 1, as for the toner of Comparative Example 1, the minimum fixing temperature is 150° C.; the number of continuously printed sheets in the printing durability test is 13,000; and the initial fog value in the high temperature and high humidity (H/H) environment is 0.5. Therefore, the toner of Comparative Example 1 has no problem with at least low-temperature fixability, printing durability, and fog in the high temperature and high humidity (H/H) environment.

However, the initial fog value of the toner of Comparative Example 1 is as high as 1.8 in the low temperature and low humidity (L/L) environment. Also, the initial conveyance amount (M/A) and the after endurance conveyance amount (M/A) of the toner of Comparative Example 1 are as large as 0.36 $mg/cm^2$ and 0.53 $mg/cm^2$, respectively. Especially, the initial conveyance amount (M/A) of Comparative Example 1 is the largest among Examples 1 to 6 and Comparative Examples 1 to 4. Also, the difference between the initial conveyance amount (M/A) and the after endurance conveyance amount (M/A) is as large as 0.17 $mg/cm^2$.

Therefore, it is clear that the toner of Comparative Example 1 that does not contain zinc oxide fine particles, is likely to cause initial fog in the low temperature and low humidity (L/L) environment, and the difference between the initial conveyance amount (M/A) and the after endurance conveyance amount (M/A) is too large.

According to Table 1, the toner of Comparative Example 2 is a toner that does not contain zinc oxide fine particles and zinc stearate fine particles. According to Table 1, as for the toner of Comparative Example 2, the minimum fixing temperature is 145° C.; the initial fog value in the high temperature and high humidity (H/H) is 1.0; and the initial conveyance amount (M/A) is 0.30 $mg/cm^2$. Therefore, the toner of Comparative Example 1 has no problem with at least low-temperature fixability and fog in the high temperature and high humidity (H/H) environment.

However, as for the toner of Comparative Example 2, the number of continuously printed sheets in the printing durability test is as small as 9,000. This number is the smallest among Examples 1 to 6 and Comparative Examples 1 to 4. Also, the initial fog value of the toner of Comparative Example 2 is as high as 3.5 in the low temperature and low humidity (L/L) environment. This value is the highest among Examples 1 to 6 and Comparative Examples 1 to 4. Also, the after endurance conveyance amount (M/A) of the toner of Comparative Example 2 is as large as 0.62 $mg/cm^2$. This amount is the largest among Examples 1 to 6 and Comparative Examples 1 to 4.

Therefore, it is clear that the toner of Comparative Example 2 that does not contain zinc oxide fine particles and zinc stearate fine particles, is poor in printing durability, is likely to cause initial fog in the low temperature and low humidity (L/L) environment, and has a large difference between the initial conveyance amount (M/A) and the after endurance conveyance amount (M/A).

According to Table 1, the toner of Comparative Example 3 is a toner that contains the irregularly-shaped zinc oxide fine particles 5 having an average particle diameter of 34 nm. According to Table 1, as for the toner of Comparative Example 3, the minimum fixing temperature is 155° C.; the initial fog value in the low temperature and low humidity (L/L) environment is 0.5; and the initial conveyance amount (M/A) is 0.31 $mg/cm^2$. Therefore, the toner of Comparative Example 1 has no problem with at least low-temperature fixability and fog in the low temperature and low humidity (L/L) environment.

However, as for the toner of Comparative Example 3, the number of continuously printed sheets in the printing durability test is as small as 11,000. Also, the initial fog value of the toner of Comparative Example 3 is as high as 2.1 in the high temperature and high humidity (H/H) environment. This value is the highest among Examples 1 to 6 and Comparative Examples 1 to 4. Also, the after endurance conveyance amount of the toner of Comparative Example 3 is as large as 0.40 $mg/cm^2$.

Therefore, it is clear that the toner of Comparative Example 3 that contains the irregularly-shaped zinc oxide fine particles, is poor in printing durability, is likely to cause initial fog in the high temperature and high humidity (H/H) environment, and has a large difference between the initial conveyance amount (M/A) and the after endurance conveyance amount (M/A).

According to Table 1, the toner of Comparative Example 4 is a toner that contains the irregularly-shaped zinc oxide fine particles 6 having an average particle diameter of 200 nm. According to Table 1, the minimum fixing temperature of the toner of Comparative Example 4 is 155° C. Therefore, the toner of Comparative Example 4 has no problem with at least low-temperature fixability.

However, as for the toner of Comparative Example 4, the number of continuously printed sheets in the printing durability test is as small as 10,000. Also, as for the toner of Comparative Example 4, the initial fog value in the low temperature and low humidity (L/L) environment and the initial fog value in the high temperature and high humidity (H/H) environment are as high as 2.2 and 1.2, respectively. Also, the after endurance conveyance amount (M/A) of the toner of Comparative Example 4 is as large as 0.41 mg/cm$^2$.

Therefore, it is clear that the toner of Comparative Example 4 that contains the irregularly-shaped zinc oxide fine particles, is poor in printing durability, is likely to cause initial fog in both the low temperature and low humidity (L/L) environment and the high temperature and high humidity (H/H) environment, and has a large difference between the initial conveyance amount (M/A) and the after endurance conveyance amount (M/A).

According to Table 1, the toners of Examples 1 to 6 are each a toner such that the content of the plate-shaped zinc oxide fine particles is in the range from 0.1 to 0.4 part by mass, with respect to 100 parts by mass of the colored resin particles, and the zinc oxide fine particles have an average longer length of 140 to 1,200 nm and a value S (value obtained by dividing particle thickness d by particle base area A) of 0.0002 to 0.0035 nm$^{-1}$. According to Table 1, as for the toners of Examples 1 to 6, the minimum fixing temperature is as low as 155° C. or less; the number of continuously printed sheets in the printing durability test is as large as 13,000 or more; the initial fog value in the low temperature and low humidity (L/L) environment is as small as 1.2 or less; the initial fog value in the high temperature and high humidity (H/H) environment is as small as 1.1 or less; the initial conveyance amount (M/A) is as small as 0.33 mg/cm$^2$ or less; and the after endurance conveyance amount (M/A) is as small as 0.39 mg/cm$^2$ or less.

Therefore, it is clear that the toners of Examples 1 to 6, each of which is such a toner that the content of the plate-shaped zinc oxide fine particles as the external additive is in the range from 0.05 to 1 part by mass, with respect to 100 parts by mass of the colored resin particles, and the zinc oxide fine particles have an average longer length of 50 to 2,000 nm and a value S (value obtained by dividing the particle thickness d by the particle base area A) of 0.0001 to 0.03 nm$^{-1}$, are toners which are able to exhibit excellent low-temperature fixability, which are able to maintain a toner conveyance amount that is almost the same as the beginning of printing even during continuous printing, and which are less likely to cause initial fog in both the high temperature and high humidity (H/H) environment and the low temperature and low humidity (L/L) environment.

Hereinafter, the effects of the difference between the content and size of the plate-shaped zinc oxide fine particles on the toner properties, will be discussed.

First, examples which are only different in the content of the plate-shaped zinc oxide fine particles 1, that is, Example 2 (content: 0.4 part), Example 3 (content: 0.1 part) and Comparative Example 2 (content: 0 part) will be compared.

According to Table 1, compared to the toner of Example 3, the toner of Example 2 is slightly higher in the minimum fixing temperature and is more likely to cause initial fog in the high temperature and high humidity (H/H) environment. However, the toner of Example 2 is slightly better in printing durability and slightly smaller in the after endurance conveyance amount (M/A) than the toner of Example 3. Also, as described above, the toner of Comparative Example 2 is poor in printing durability, is likely to cause initial fog in the low temperature and low humidity (L/L) environment, and has a large difference between the initial conveyance amount (M/A) and the after endurance conveyance amount (M/A).

From the above results, it is presumed that as the content of the plate-shaped zinc oxide fine particles 1 increases, the difference between the initial conveyance amount (M/A) and the after endurance conveyance amount (M/A) decreases, which is an effect due to the plate-shaped zinc oxide fine particles 1, and printing durability improves; meanwhile, low-temperature fixability slightly deteriorates. To the contrary, it is presumed that as the content of the plate-shaped zinc oxide fine particles 1 decreases, low-temperature fixability increases; meanwhile, the difference between the initial conveyance amount (M/A) and the after endurance conveyance amount (M/A) slightly increases, and printing durability slightly decreases.

Next, examples which are only different in the size of the plate-shaped zinc oxide fine particles, that is, Example 4 (average longer length: 1,200 nm), Example 5 (average longer length: 350 nm) and Example 6 (average longer length: 140 nm) will be compared.

According to Table 1, compared to the toner of Example 5, the toner of Example 4 is slightly lower in the minimum fixing temperature; meanwhile, it is slightly poorer in printing durability, is slightly more likely to cause initial fog in the low temperature and low humidity (L/L) environment, and is slightly higher in after endurance conveyance amount (M/A). Also, compared to the toner of Example 5, the toner of Example 6 is slightly more likely to cause initial fog in the high temperature and high humidity (H/H) environment.

From the above results, it is presumed that as the average longer length of the plate-shaped zinc oxide fine particles increases, low-temperature fixability increases; meanwhile, printing durability slightly decreases; initial fog is slightly more likely to occur in the low temperature and low humidity (L/L) environment; and the difference between the initial conveyance amount (M/A) and the after endurance conveyance amount (M/A) slightly increases. To the contrary, it is presumed that as the average longer length of the plate-shaped zinc oxide fine particles decreases, printing durability increases, and the difference between the initial conveyance amount (M/A) and the after endurance conveyance amount (M/A) decreases; meanwhile, initial fog is slightly more likely to occur in the high temperature and high humidity (H/H) environment.

REFERENCE SIGNS LIST

100. Hexagonal plate-shaped zinc oxide fine particle
A. Base area of the particle
d. Thickness of the particle
L. Longer length of the particle
$l_1$, $l_2$. Shorter length of the particle
w. Width of the particle
$w_1$, $w_2$. Partial width of the particle

The invention claimed is:

1. An electrostatic image developer comprising colored resin particles containing a binder resin and a colorant, and an external additive, wherein, as the external additive, the electrostatic image developer contains plate-shaped zinc oxide fine particles having an average longer length of 50 to 2,000 nm and a value S of 0.0001 to 0.03 nm$^{-1}$, which is a value obtained by dividing an average thickness d of the particles by an average base area A of the particles, a content of the plate-shaped zinc oxide fine particles is in the range from 0.05 to 1 part by mass, with respect to 100 parts by mass of the colored resin particles, and the plate-shaped zinc oxide fine particles have a BET specific surface area of 1 to 40 $m^2/g$.

2. The electrostatic image developer according to claim 1, comprising the colored resin particles containing the binder resin, the colorant and a charge control agent, and the external additive, wherein, as the external additive, the electrostatic image developer contains the plate-shaped zinc oxide fine particles having an average longer length of 50 to 2,000 nm and a value S of 0.0001 to 0.03 $nm^{-1}$, which is the value obtained by dividing the average thickness d of the particles by the average base area A of the particles, the content of the plate-shaped zinc oxide fine particles is in the range from 0.05 to 1 part by mass, with respect to 100 parts by mass of the colored resin particles, and the plate-shaped zinc oxide fine particles have a BET specific surface area of 1 to $40m^2/g$.

3. The electrostatic image developer according to claim 1, wherein the base of the plate-shaped zinc oxide fine particles is hexagonal.

4. The electrostatic image developer according to claim 1, wherein, as the external additives, the electrostatic image developer further contains inorganic fine particles A having a number average primary particle diameter of 36 to 200 nm and inorganic fine particles B having a number average primary particle diameter of 7 to 35 nm, and with respect to 100 parts by mass of the colored resin particles, the electrostatic image developer contains the inorganic fine particles A in the range from 0.1 to 3 parts by mass and the inorganic fine particles B in the range from 0.1 to 2 parts by mass.

5. The electrostatic image developer according to claim 1, wherein, as the external additive, the electrostatic image developer further contains fatty acid metal salt fine particles having a number average primary particle diameter of 0.05 to 5 μm.

* * * * *